US007662336B2

(12) United States Patent
Schubert et al.

(10) Patent No.: US 7,662,336 B2
(45) Date of Patent: Feb. 16, 2010

(54) VESSEL FOR THE METALLURGICAL TREATMENT OF PIG IRON, STEEL MELTS AND SIMILAR, IN PARTICULAR A CONVERTER VESSEL

(75) Inventors: Bernd Schubert, Dorsten (DE); Winfried Laubach, Oberhausen (DE)

(73) Assignee: SMS Demag AG, Düsseldorf (DE)

( * ) Notice: Subject to any disclaimer, the term of this patent is extended or adjusted under 35 U.S.C. 154(b) by 602 days.

(21) Appl. No.: 10/534,240

(22) PCT Filed: Sep. 26, 2003

(86) PCT No.: PCT/EP03/10760

§ 371 (c)(1), (2), (4) Date: Oct. 24, 2005

(87) PCT Pub. No.: WO2004/042091

PCT Pub. Date: May 21, 2004

(65) Prior Publication Data

US 2006/0131796 A1 Jun. 22, 2006

(30) Foreign Application Priority Data

Nov. 8, 2002 (DE) ..... 102 51 964

(51) Int. Cl.
*C21C 5/50* (2006.01)

(52) U.S. Cl. ..... 266/246; 266/275

(58) Field of Classification Search ..... 266/243–247, 266/275–276

See application file for complete search history.

(56) References Cited

U.S. PATENT DOCUMENTS 3,561,744 A 2/1971 Altman et al.
5,364,079 A 11/1994 Gruber et al.

*Primary Examiner*—Scott Kastler
(74) *Attorney, Agent, or Firm*—Friedrich Kueffner

(57) ABSTRACT

The invention relates to a vessel (1) for the metallurgical treatment of pig iron, steel melts and similar, in particular a converter vessel, mounted on a support ring (3), arranged at a separation by means of pivot pins, whereby the vessel (1) rests on the top flange (3*a*) of the support ring (3) by means of claws (6) on the vessel wall (1*b*) and a support (4) is detachably embodied with additional fixing elements on the top flange (3*a*) of the support ring (3). According to the invention, the disadvantage of having to work in hot, restricted regions which are difficult for the personnel to access can be avoided, whereby the support on the top flange (3*a*) of the support ring (3) comprises opposing vessel brackets (7) and support ring brackets (8) which can be tensioned together in a closing direction (10) by means of a hinged closure (9) until a secure closed position is achieved and which may be easily opened in the opposing operating direction (12).

12 Claims, 4 Drawing Sheets

VESSEL FOR THE METALLURGICAL TREATMENT OF PIG IRON, STEEL MELTS AND SIMILAR, IN PARTICULAR A CONVERTER VESSEL

The invention concerns a vessel for the metallurgical treatment of pig iron, steel melts, and the like, especially a converter vessel, which is supported on a trunnion ring spaced some distance from the vessel, which trunnion ring can be tilted by means of trunnions in rocker bearings on both sides, wherein claws distributed along the circumference of the vessel wall rest on the upper flange of the trunnion ring, and wherein a support is designed to be releasably mounted on the upper flange of the trunnion ring by means of additional mounting fixtures.

The creation of a converter vessel of more or less the design described above, whose individual parts can be replaced by simple means and, to this end, the creation of a releasable connection between the vessel claws and the trunnion ring and between guide pieces and additional mounting fixtures is a well-known problem (DE 199 28 195 A1). However, there is a lack of suitable means for carrying out this detachment and reattachment of a vessel to be changed under the conditions of a hot converter vessel.

In practice, due to the relatively intense wear of the vessel lining, metallurgical treatment vessels require quick replacement to minimize production downtime.

Replacement has previously been based on mounting fixtures, for example, clamping screws, hinged screws, and suitably operated clamping mechanisms, in addition to the claws that are positioned in guides that are open at the top, all of which have the aforementioned disadvantages and are difficult to handle, and whose handling takes too much time. Furthermore, due to the operationally related heating of the vessels, thermal expansion occurs in the individual parts, which makes it difficult to release the mounting fixtures. Moreover, there is the additional problem that the release and replacement operation must be carried out by the operating personnel in the immediate vicinity of the vessel at the high ambient temperatures. With the relatively restricted accessibility, the loosening of tightening nuts with a suitable tool takes a great deal of effort.

The objective of the invention is to propose means that are fast and easy and can be handled at a sufficient distance and that do not have the disadvantages specified above.

In accordance with the invention, this objective is achieved by providing that the support on the upper flange of the trunnion ring consists of opposing vessel brackets and trunnion ring brackets, which can be tensioned together in a closing direction by means of a hinged closure until a secure closed position is achieved and which can be easily released in the opposite operating direction. In the closed state, an operating device is moved over so-called dead center and can be brought into a self-locking and securely locked position. The brackets distributed along the periphery can be arranged symmetrically or asymmetrically, depending on the shape of the trunnion ring, and serve as points of engagement for a quick-attachment device of this type. The resulting compound lever arrangement is adjusted to the clamping intervals and ensures secure support of the vessel even in tilted positions. In addition, the hinged closure can be easily and safely pushed into the closed position or the release position with a manually applied hydraulic handling device. Accordingly, the same auxiliary device can be applied for opening. In this regard, it is first moved out of the dead-center position until the open position is reached.

In particular, it is provided that the hinged closure consists of a clamp, which embraces the vessel bracket and is rotatably supported on an operating lever, such that the upper end of the operating lever is rotatably supported on the trunnion ring bracket. This also results in only slight expense per mounting point.

This design is further developed in such a way that the clamp embraces the vessel bracket in the closing direction and rests against the outer peripheral surface of the trunnion ring and in such a way that the operating lever is locked with lock bolts mounted on the clamps on both sides. Pushing the operating lever back on the trunnion ring causes swinging away from the trunnion ring and releases the vessel bracket to allow dismounting of the vessel. An operating mechanism of this type saves the need for the otherwise customary supporting elements with a spherical seat and the corresponding handling of the parts. As far as the operating personnel are concerned, only a small amount of effort and relatively brief access to the quick-change mounting system are necessary.

The release of the vessel can be accomplished in a simple way by virtue of the fact that, during an opening movement of the operating lever from the peripheral surface of the trunnion ring towards the outside, the clamp can be rotated over the vessel bracket until an open position is reached.

In this regard, the arrangement is designed in such a way that, in the side profile, the vessel bracket forms a lower recess, in which the trunnion ring bracket finds space with clearance. In this way, very little space is used.

The number of vessel brackets and trunnion ring brackets depends on the shape of the trunnion ring (whether it is a full ring or partial ring). Furthermore, the hinged closure can be mounted on the upper flange on the outside or spaced between the trunnion ring and the vessel.

In a first alternative embodiment, the vessel bracket consists of two bracket plates arranged laterally with fixed spacing.

In a second alternative embodiment, the vessel bracket consists of a single, correspondingly thickly dimensioned bracket plate.

Analogously to these two embodiments, the trunnion ring bracket consists of a single, correspondingly dimensioned bracket plate.

In accordance with a refinement, the associated lever systems are designed in such a way that the clamp consists of two spaced, parallel clamping cover plates, which are connected at their ends by a transverse spacer element, or are rotatably connected with spaced trunnion ring bracket plates, such that in a middle, thick trunnion ring bracket, the spacer element holds lever cover plates for the operating lever and forms its pivot bearing.

Analogously to the design of the clamp, the operating lever consists of two spaced, parallel lever cover plates, which are connected by transverse spacer elements and form the pivot bearing.

In another embodiment, a clamping element consists of a tension lever arm, which runs between the spaced, parallel vessel brackets and between spaced trunnion ring bracket plates, is connected to the pivot bearing connecting the two lever cover plates, runs between two trunnion ring bracket plates, and has a hammerhead that rests on the bracket plates.

In accordance with other features, the tension lever arm runs between two trunnion ring bracket plates and forms an oval, closed clamp that embraces the vessel bracket.

Embodiments of the invention are illustrated in the drawings and explained in greater detail below.

Figure 1:
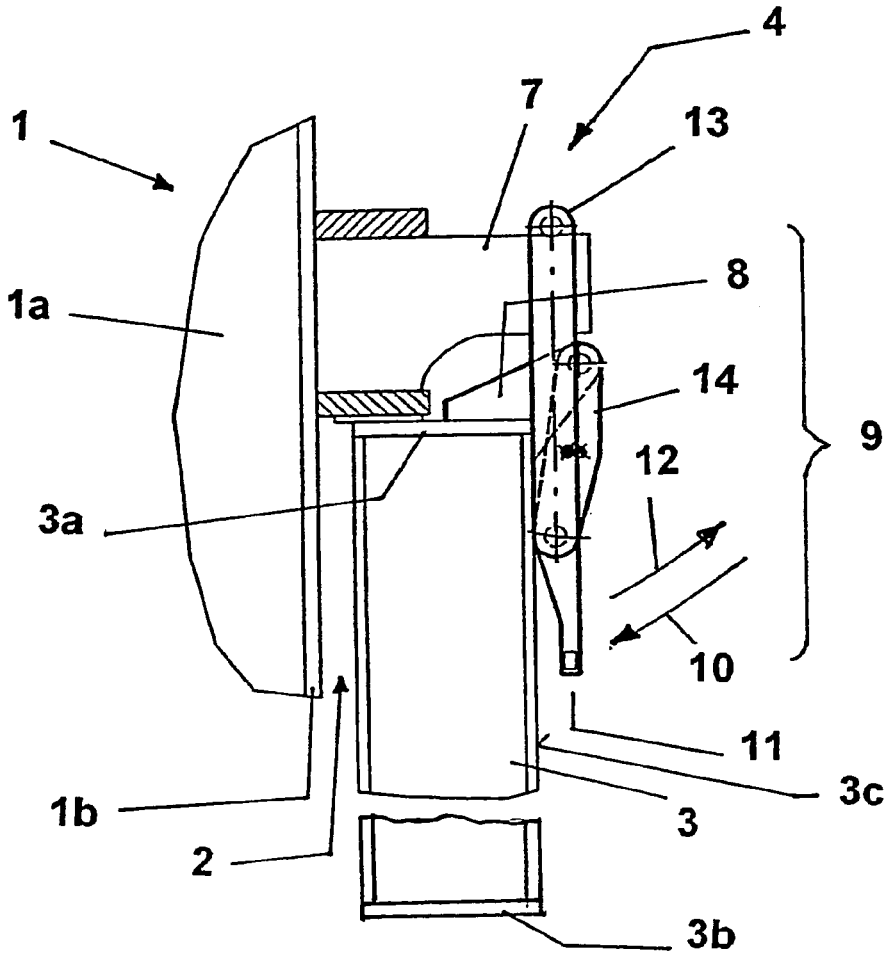
FIG. 1 shows a cutaway side view of a vessel with vessel bracket, trunnion ring bracket, and hinged closure.
Figure 2:
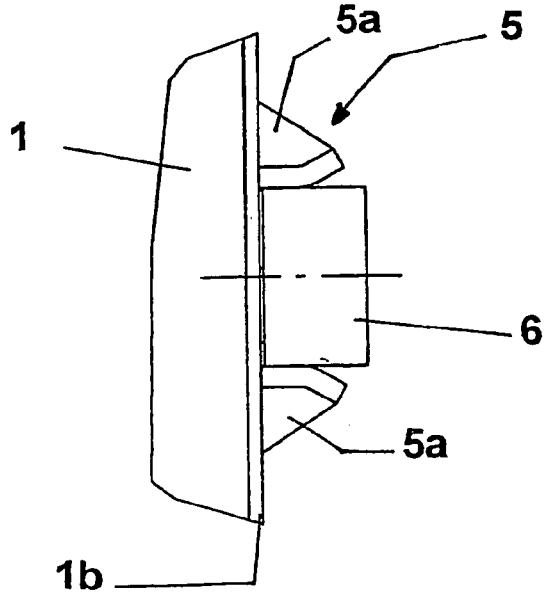
FIG. 2 shows a cutaway top view of the guide walls arranged on both sides of a claw.

A vessel 1, which consists, for example, of a converter vessel 1*a*, is used for the metallurgical treatment of melts, e.g., the decarburization of pig iron or steel melts. The vessel 1 is supported on a trunnion ring 3, with some spacing 2 between the vessel and trunnion ring, by means of claws 6 mounted along the circumference of the vessel wall 1*b* and between these claws or supports 4 assigned to the claws. The supports 4 consist of additional mounting fixtures. The trunnion ring 3, which forms an upper flange 3*a* and a lower flange 3*b*, supports the claws 6 of the vessel 1. The claws 6 are open at the top and are positioned laterally between guide walls 5*a*, which form vessel guides 5.

The additional mounting fixtures are located between each two adjacent claws 6. Several vessel brackets 7 are located there on the vessel wall 1*b*, suitably distributed along the periphery. Analogous trunnion ring brackets 8 are mounted on an upper flange 3*a* of the trunnion ring 3.

Each support (FIG. 1) on the upper flange 3*a* of the trunnion ring 3 consists of an opposing vessel bracket 7 and a trunnion ring bracket 8, which can be tensioned together in a closing direction 10 by means of a hinged closure 9, which will be described in greater detail below, until a secured closed position 11 is achieved and can be easily released in the opposite operating direction 12.

The hinged closure 9 (FIG. 3, which shows it opened about halfway) consists of a clamp 13 that embraces the vessel bracket 7 and is rotatably supported on an operating lever 14. The operating lever 14 is rotatably supported at its upper end 14*a* on the trunnion ring bracket 8. In the closed position 11, the clamp 13 embraces the vessel bracket 7 and rests (FIG. 1) on the outer peripheral surface 3*c* of the trunnion ring 3 and is locked by means of lock bolts 15, which are mounted on both sides on the clamp 13 in clamping cover plates 13*a*, 13*a*.

Figure 3:
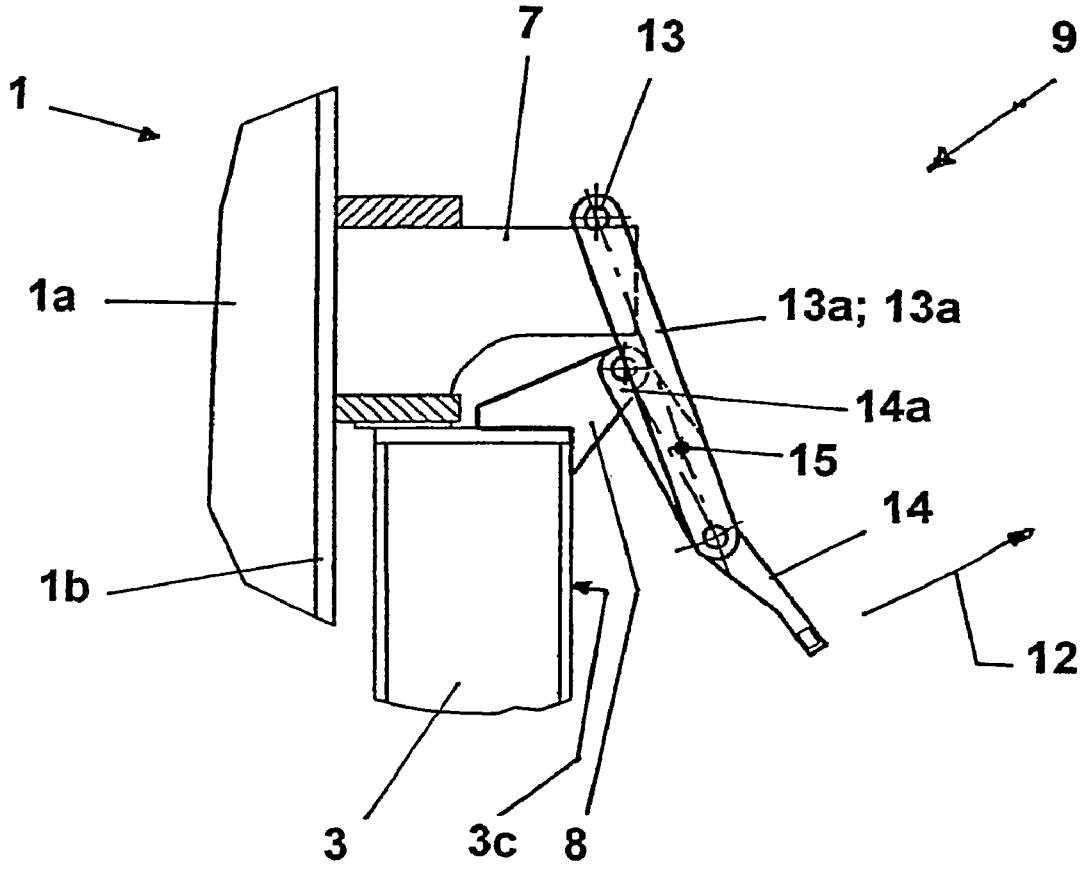
FIG. 3 shows the same side view as FIG. 1 with the hinged closure in the open position.
Figure 4:
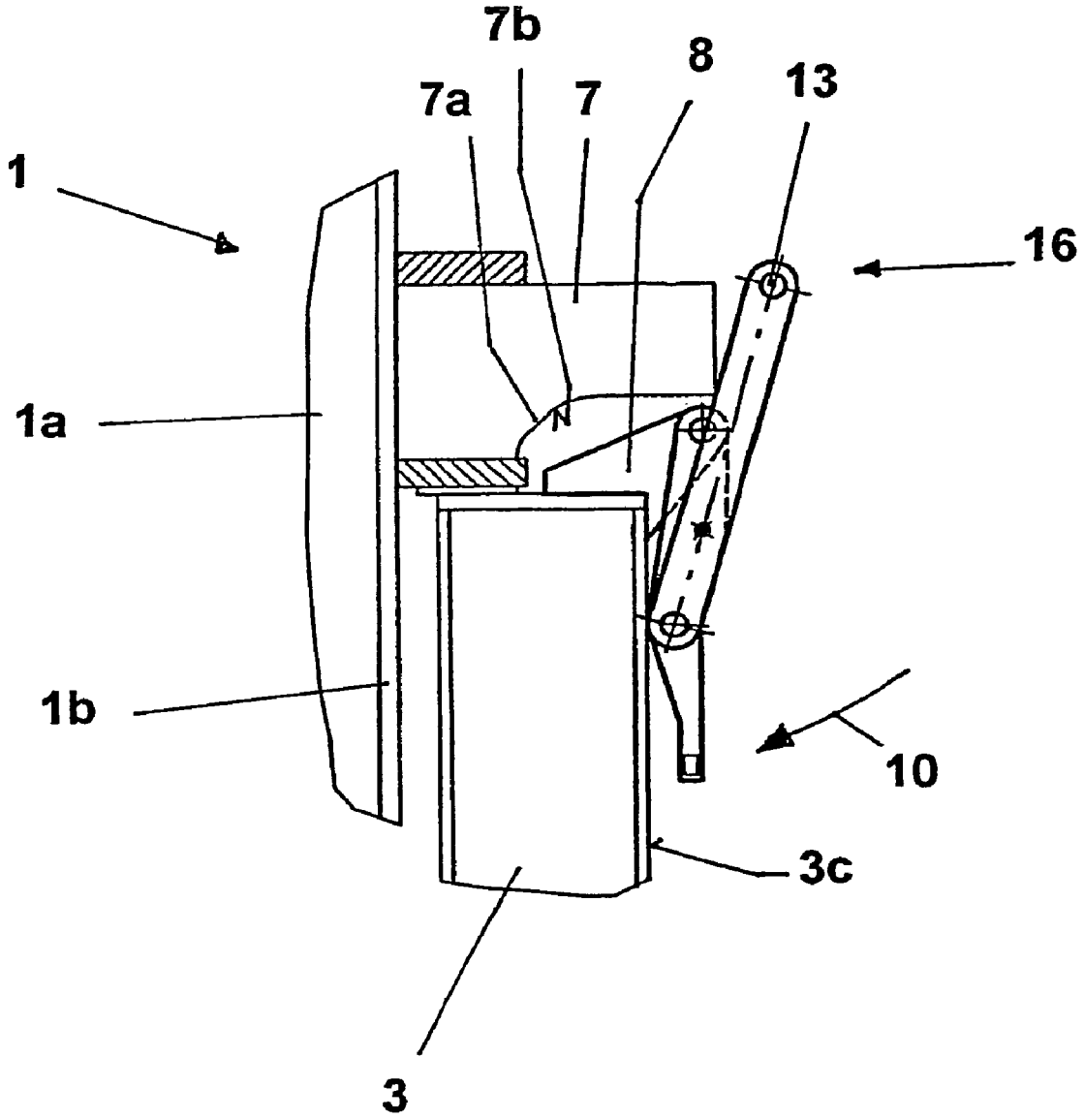
FIG. 4 shows the same side view as FIG. 1 with the hinged closure in a secured open position.

As shown in FIGS. 3 and 4, the clamp 13 moves in the opposite operating direction 12 during the opening movement and back into the closed position 11 over the vessel bracket 7. The operating lever 14 first moves away from the outer peripheral surface 3*c* of the trunnion ring 3 (FIG. 3) and then approaches it again (FIG. 4). The open position 16 is reached in this way.

To achieve a compact arrangement and lever paths as small as possible, the vessel bracket 7 in the side profile 7*a* forms a lower recess 7*b*, in which the trunnion ring bracket 8 finds space with clearance.

FIGS. 5 to 8 show various alternatives for the vessel bracket 7, the trunnion ring bracket 8, and the clamp 13.

Figure 5:
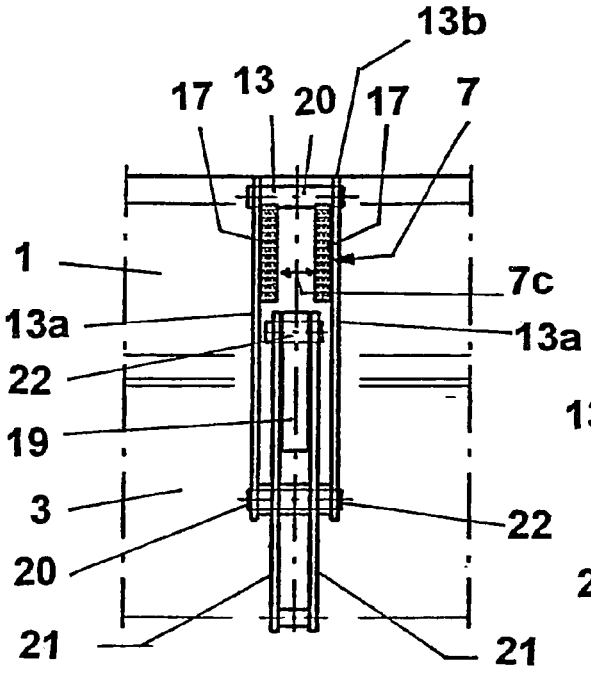
FIG. 5 shows a cutaway front elevation of the vessel and trunnion ring with paired vessel bracket plates and a single trunnion ring bracket plate.

In FIG. 5, the vessel bracket 7 consists of two bracket plates 17 arranged laterally with a fixed space 7*c* between them.

Figure 7:
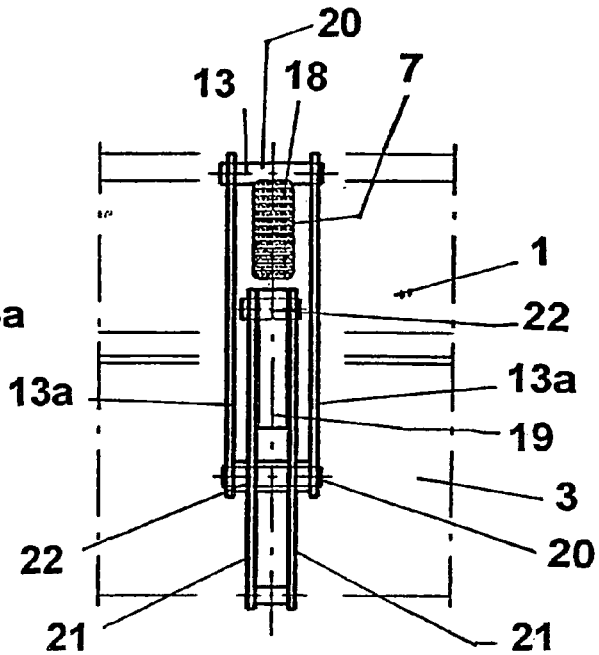
FIG. 7 shows the same front elevation with a single vessel bracket plate and a single trunnion ring bracket plate.

In FIG. 7, on the other hand, the vessel bracket 7 consists of a single, correspondingly thickly dimensioned bracket plate 18.

In FIG. 5, the trunnion ring bracket 8 is analogously produced from a single, correspondingly thickly dimensioned bracket plate 19.

The clamp 13 (FIGS. 5 and 7) consists of two spaced, parallel clamping cover plates 13*a* and 13, which are connected at their ends 13*b* by a transverse spacer element 20.

Figure 6:
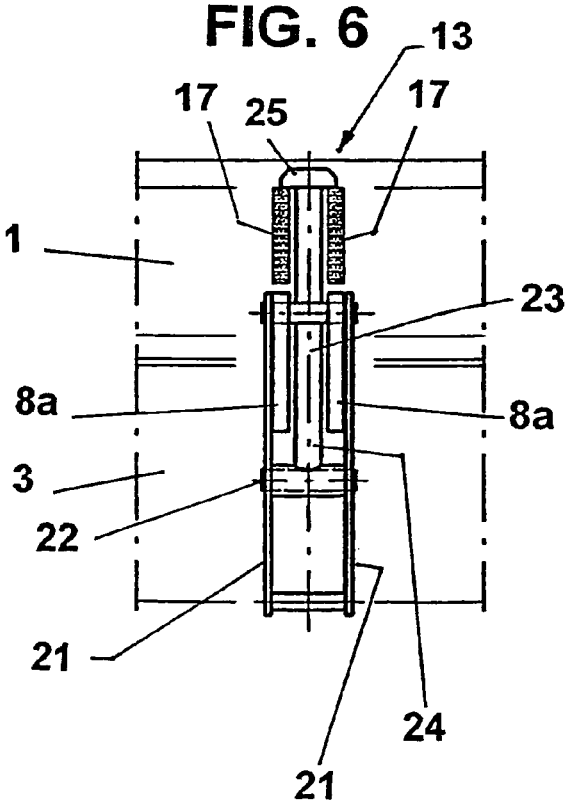
FIG. 6 shows the same cutaway front elevation of the vessel and trunnion ring with paired vessel bracket plates and trunnion ring bracket plates.
Figure 8:
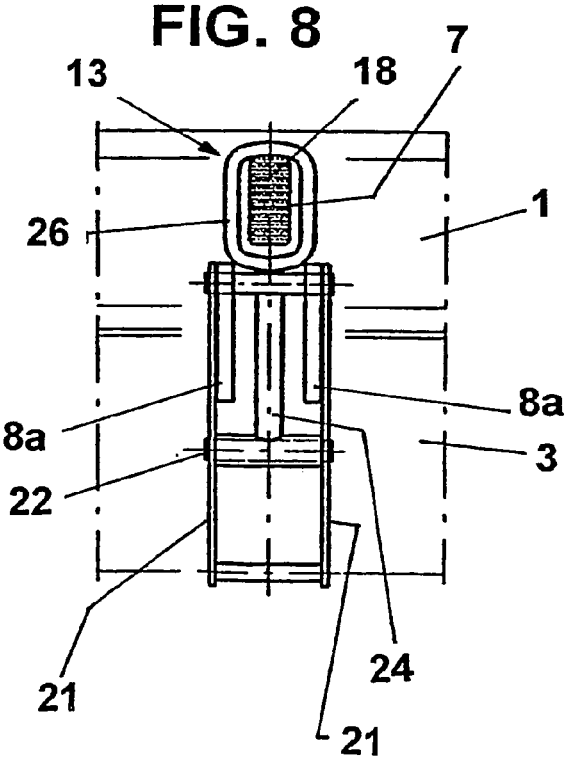
FIG. 8 shows a front elevation with a single vessel bracket plate and paired trunnion ring bracket plates.

In FIGS. 6 and 8, spaced trunnion ring bracket plates 8*a* are provided. A pivot bearing 22 that allows the clamp 13 to rotate relative to the operating lever 14 can also be provided in the trunnion ring bracket plates 8*a*. In the middle, thick trunnion ring bracket plate 19, the spacer element 20, which holds lever cover plates 21 for the operating lever 14, is provided for a pivot bearing 22.

As shown in FIGS. 5, 6, 7, and 8, the operating lever 14 consists of two spaced, parallel lever cover plates 21, which hold the pivot bearing 22. The lever cover plates 21 are connected by the transverse spacer elements 20.

FIGS. 6 and 7 show other alternative embodiments with respect to the design of the clamp 13. A clamp 13 is provided in the form of a clamping element 23, which consists of a tension lever arm 24, which runs between the spaced, parallel vessel brackets 7 and between spaced trunnion ring bracket plates 8*a* and has a hammerhead that rests on the bracket plates. The tension lever arm 24 is itself connected to the pivot bearing 22 that connects the two lever cover plates 21 and runs between two trunnion ring bracket plates 8*a*.

In FIG. 8, the tension lever arm 24 runs between two trunnion ring bracket plates 8*a* and forms an oval, closed clamp 26 that embraces the vessel bracket 7.

LIST OF REFERENCE NUMBERS

1 vessel
1*a* converter vessel
1*b* vessel wall
2 spacing
3 trunnion ring
3*a* upper flange
3*b* lower flange
3*c* outer peripheral surface
4 support
5 vessel guide
5*a* guide wall
5*b* guide piece
6 claws
7 vessel bracket
7*a* side profile
7*b* lower recess
7*c* lateral spacing
8 trunnion ring bracket
8*a* trunnion ring bracket plate
9 hinged closure
10 closing direction
11 closed position
12 opposite operating direction
13 clamp
13*a* clamping cover plates
13*b* end of clamping cover plate
14 operating lever
14*a* upper end of operating lever
15 lock bolt
16 open position
17 spaced vessel bracket plates
18 single, thick vessel bracket plate
19 single, thick trunnion ring bracket plate
20 spacer element
21 lever cover plates

22 pivot bearing
23 clamping element
24 tension lever arm
25 hammerhead
26 closed clamp

The invention claimed is:

1. Vessel (1) for the metallurgical treatment of pig iron, steel melts, and the like, comprising a converter vessel (1*a*), which is supported on a trunnion ring (3) spaced some distance (2) from the vessel, which trunnion ring (3) can be tilted by trunnions in rocker bearings on both sides, wherein claws (6) distributed along the circumference of the vessel wall (1*b*) rest on an upper flange (3*a*) of the trunnion ring (3), and wherein a support (4) is designed to be releasably mounted on the upper flange (3*a*) of the trunnion ring (3) by additional mounting fixtures, wherein the support (4) on the upper flange (3*a*) of the trunnion ring (3) consists of opposing vessel brackets (7) and trunnion ring brackets (8), which can be tensioned together in a closing direction (10) by means of a hinged closure (9) until a secure closed position (11) is achieved and which can be easily released in the opposite operating direction (12).

2. Vessel in accordance with claim 1, wherein the hinged closure (9) consists of a clamp (13), which embraces the vessel bracket (7) and is rotatably supported on an operating lever (14), such that the upper end (14*a*) of the operating lever (14) is rotatably supported on the trunnion ring bracket (8).

3. Vessel in accordance with claim 2, wherein the clamp (13) embraces the vessel bracket (7) in the closing direction (10) and rests against the outer peripheral surface (3*c*) of the trunnion ring (3) in the closed position (11) and that the operating lever (14) is locked with lock bolts (15) mounted on the clamp (13) on both sides.

4. Vessel in accordance with claim 2, wherein during an opening movement of the operating lever (14) from the peripheral surface (3*c*) of the trunnion ring (3) towards the outside, the clamp (13) can be rotated over the vessel bracket (7) until an open position (16) is reached.

5. Vessel in accordance with claim 1, wherein, in a side profile (7*a*), the vessel bracket (7) forms a lower recess (7*b*), in which the trunnion ring bracket (8) finds space with clearance.

6. Vessel in accordance with claim 1, wherein the vessel bracket (7) consists of two bracket plates (17) arranged laterally with fixed spacing (7*c*).

7. Vessel in accordance with claim 1, wherein the vessel bracket (7) consists of a single, correspondingly thickly dimensioned bracket plate (18).

8. Vessel in accordance with claim 1, wherein the trunnion ring bracket (8) consists of a single, correspondingly dimensioned bracket plate (19).

9. Vessel in accordance with claim 2, wherein the clamp (13) consists of two spaced, parallel clamping cover plates (13*a*; 13*a*), which are connected at their ends (13*b*) by a transverse spacer element (20), or are rotatably connected with spaced trunnion ring bracket plates (8*a*),or in a middle, thick trunnion ring bracket (8), the spacer element (20) holds lever cover plates (21) for the operating lever (14) and forms its pivot bearing (22).

10. Vessel in accordance with claim 2, wherein the operating lever (14) consists of two spaced, parallel lever cover plates (21), which are connected by transverse spacer elements (20) and form a pivot bearing (22).

11. Vessel in accordance with claim 10, wherein a clamping element (23) consists of a tension lever arm (24), which runs between the spaced, parallel vessel brackets (7) and between spaced trunnion ring bracket plates (8*a*), is connected to the pivot bearing (22) connecting the two lever cover plates (21), runs between two trunnion ring bracket plates (8*a*), and has a hammerhead (25) that rests on the bracket plates.

12. Vessel in accordance with claim 10, wherein the tension lever arm (24) runs between two trunnion ring bracket plates (8*a*) and forms an oval, closed clamp (26) that embraces the vessel bracket (7).

* * * * *